US005424799A

United States Patent [19]

Nakamura et al.

[11] Patent Number: 5,424,799

[45] Date of Patent: Jun. 13, 1995

[54] LIGHT-SENSITIVE MATERIAL TREATING APPARATUS

[75] Inventors: Takashi Nakamura; Yasuhisa Ogawa, both of Kanagawa, Japan

[73] Assignee: Fuji Photo Film Co., Ltd., Japan

[21] Appl. No.: 60,059

[22] Filed: May 13, 1993

[30] Foreign Application Priority Data

Jun. 1, 1992 [JP] Japan ..... 4-163388

[51] Int. Cl.[6] ..... G03D 3/02

[52] U.S. Cl. ..... 354/324; 204/109

[58] Field of Search ..... 354/324; 204/109, 104–108, 204/110, 11; 430/393, 398, 399, 400

[56] References Cited

U.S. PATENT DOCUMENTS 4,217,188 8/1980 Ono ..... 204/109

*Primary Examiner*—D. Rutledge

*Attorney, Agent, or Firm*—Sughrue, Mion, Zinn, Macpeak & Seas

[57] ABSTRACT

A light-sensitive material treating apparatus which is small in size and produces a reduced quantity of waste fluid. A current conduction process is applied to a developing solution using an auxiliary tank communicated with a developing tank and to which a supplementary solution is supplied. The developing solution contains a developing agent which is oxidized to an oxidation state by reaction with silver halide and reduced to a reduction state by electronation. The auxiliary tank is separated into two chambers by a cation-exchange membrane, and a cathode and an anode are provided in respective ones of the chambers arranged opposite to each other with respect to the cation-exchange membrane. A current is applied between the two electrodes. The current conduction time is controlled on the basis of current conduction efficiency corresponding to the time of use.

24 Claims, 6 Drawing Sheets

LIGHT-SENSITIVE MATERIAL TREATING APPARATUS

BACKGROUND OF THE INVENTION

The present invention relates to an apparatus for treating a silver halide photographic light-sensitive material, in which electrodes are provided in a developing tank and in which the treating ability of a developing solution can be recovered through applying a current to the developing solution between the electrodes.

For example, wet treatment for a silver halide monochrome photographic light-sensitive material is carried out by treatment processes such as developing, fixing, washing, and the like. If necessary, processes such as washing and the like may be effected between the respective processes. A developing solution and a fixing solution are used in these developing and fixing processes, respectively. As the light-sensitive material is treated, a developing agent contained in the developing solution is oxidized so that the developing solution becomes tired and halogen ions are accumulated in the developing solution. Furthermore, silver ions and halogen ions are accumulated in the fixing solution due to the fixing operation. As a result, the treating abilities of those solutions are lowered. Therefore, supplementary solutions, each containing necessary components similar to those of a corresponding treatment solution, are respectively supplied to the treatment solutions so -that the treating abilities of the treatment solutions can be maintained.

If supplementary solutions are supplied to the respective treatment solutions so that the treating abilities of the treatment solutions are not lowered, however, overflow liquid of a quantity substantially equal to the quantity of the supplied liquid is discharged as waste fluid. The waste fluid is discarded, eventually reaching the sea, resulting in global environmental pollution.

In recent years, however, discharge of photographic treatment waste fluid into the sea has been reconsidered in light of the growing consensus that the global environment must be protected. Although a method of destroying photographic treatment waste fluid by incineration may be proposed instead of discharge into the sea, the method results in another type of global environmental pollution problem due to the discharge of carbon dioxide. Accordingly, techniques for rendering waste fluid harmless and techniques for reducing the quantity of waste fluid have been desired to replace the conventional methods.

Examples of techniques for rendering photographic waste fluids harmless include an activated-sludge process employing a biological treatment, wet oxidation process, and the like. These processes, however, require large-scale treatment apparatuses, so that it is necessary to collect waste fluid and apply batch integrated treatment to the collected waste fluid. As examples of techniques for reducing the quantity of waste fluid, a low supplement system, an on-site liquid regeneration system (apparatus in which an automatic developing apparatus and a treatment solution regeneration apparatus are integrated into one unit), an on-site waste fluid treatment system (apparatus in which an automatic developing apparatus and a waste fluid treatment apparatus are integrated into a single unit), and the like, are known. These are, however, techniques effective only for large-scale treatment laboratories.

On the other hand, with the advance of technology, photographic treatment is carried out not only at the level of large- to small-scale laboratories, but also in the so-called "mini-" and "micro-scale" laboratory level. Particularly at the mini-scale laboratory level and in the micro-scale laboratory level, the problem on waste fluid has been exacerbated since photographic treatment at many different locations. That is, at tile mini-scale laboratory level it is quite difficult to treat waste fluid with an apparatus united with the automatic developing apparatus. Also, the costs for collecting the waste fluid are high, and it is substantially difficult to collect the waste fluid.

Significant reduction of the amount of waste fluid discharged can be attained if the quantity of supplementary solution is extremely reduced. In such a case, however, it is necessary to recover the treating ability by other means. For example, in the case of a developing solution, recovering the ability of the treatment solution is synonymous with reducing a developing agent oxidized by developing treatment. This reduction must be accomplished by means other than addition of a supplementary solution.

In the case where a chelate metal compound is used as a developing agent in the development of a light-sensitive material, the chelate metal compound is oxidized by reduction of silver halide in the light-sensitive material so that chelate metal ions turn to higher-valency ions. That is, by subjecting the chelate metal ions to development, the valence of the ions increases. For example, in the case where chelate Fe(II) is used as the chelate metal compound, chelate $Fe^{2+}$ turns to chelate $Fe^{3+}$ with the advance of the developing treatment, so that the relative proportion of chelate $Fe^{3+}$ increases.

The developing ability of the developing solution in a state where chelate $Fe^{3+}$ has increased can be recovered by returning the chelate $Fe^{3+}$ to chelate $Fe^{2+}$. For example, chelate $Fe^{3+}$ can be returned to chelate $Fe^{2+}$ by giving electrons to chelate $Fe^{3+}$. Therefore, it may be considered to employ a known electrolysis apparatus for applying a current to a liquid to perform oxidation or reduction for regeneration of a developing solution. Examples of such an approach are described in Japanese Patent Unexamined Publications Nos. Hei-3273237, Hei-3-209471 and Hei-3-293661.

However, in the case where a tired developing solution in the developing tank is to be recovered using an electrolysis apparatus, not only is work such as transferring the developing solution to the electrolysis apparatus troublesome, but the structure of equipment required for directly transferring the developing solution from the developing apparatus to the electrolysis apparatus is large in size because of the required pipes, circulatory pumps, filters and the like.

SUMMARY OF THE INVENTION

An object of the present invention is to solve the above-described problems in the prior art, that is, to provide a light-sensitive material treatment apparatus in which the developing ability of a developing solution lowered by aeration and by development of a light-sensitive material, can be recovered well by a simple and small-sized structure so that not only can good treatment be continued for a long time, even in the case of low or no supplementation, but less waste fluid is produced.

The foregoing and other objects of the invention have been achieved by an apparatus for treating a silver halide photographic light-sensitive material comprising a developing tank filled with a developing solution containing a developing agent which is converted to an oxidation state by reaction with silver halide and is returned to a reduction state by electronation, an auxiliary tank arranged so as to be communicated with the developing tank and to which a supplementary solution is supplied, a current conduction tank filled with an electrolytic solution in contact with the developing solution in the auxiliary tank through a septum, a cathode in contact with the developing solution in the auxiliary tank, an anode in contact with the electrolytic solution, and means for applying a current between the two electrodes. A nozzle may be provided for supplying the supplementary solution to the auxiliary tank, extending downward to a liquid surface. This nozzle has a supplementary port opening obliquely or as a vertical slit and an open end portion in contact with the surface of a treatment solution.

The invention may also be practiced by an apparatus comprising a developing tank filled with a developing solution containing a developing agent converted to an oxidation state by reaction with silver halide and returned to a reduction state by electronation, a current conduction tank filled with an electrolytic solution in contact with the developing solution through a septum, a cathode in contact with the developing solution in the developing tank, an anode in contact with the electrolytic solution, means for applying a current between the two electrodes, storage means for storing a value representing a treatment efficiency corresponding to the time during which the septum is used, means for determining the time during which the septum is used, arithmetic operation means for calculating the product of the treatment efficiency and the time during which the septum is used, and control means for controlling the quantity of current conduction so that the product is kept constant.

Yet further, the invention provides an apparatus for treating a light-sensitive material comprising a current conduction cartridge including an inner tank and an outer tank which are formed in the current conduction cartridge by separating at least one part of the current conduction cartridge by a septum, a photographic treatment solution introduced into one of the inner and outer tanks, an electrolytic solution introduced into the other of the inner and outer tanks, and two different-polarity electrodes in contact with the treatment solution and the electrolytic solution, respectively, wherein the current conduction cartridge is provided to regenerate the treatment solution through applying a current between the two electrodes and is detachably attached to a treatment solution circulating path in a body of the treatment apparatus.

Still further, the invention encompasses an apparatus for treating a light-sensitive material, comprising a current conduction cartridge including two chambers formed in the current conduction cartridge by separating at least one part of the current conduction cartridge by a septum, a photographic treatment solution introduced into one of the two chambers, an electrolytic solution introduced into the other of the two chambers, and two different-polarity electrodes in contact with the treatment solution and the electrolytic solution, respectively, wherein the current conduction cartridge is provided to regenerate the treatment solution through applying a current between the two electrodes and disposed in a treatment solution circulating path in a body of the treatment apparatus so that any one of the two chambers is attachable to the septum and detachable from the septum. The cartridge preferably has a liquid inlet and a liquid outlet which are located in diagonal positions. At least one of the electrodes is shaped like a cylinder.

When a current is applied to a developing solution, the developing ability is recovered through the reaction that a developing agent and preservatives oxidized by aeration during the rest of treatment and by development of a light-sensitive material are reduced by electronation on a surface of an electrode (cathode). As a result, a sufficient image density can be obtained, so that both lowering of sensitivity and softening of gradation can be prevented.

For example, in the case where chelate Fe(II) is used as a chelate metal compound, the current conduction process gives electrons from the cathode to chelate $Fe^{3+}$ increased by aeration and by development so that trivalent chelate iron ions return to bivalent ions, thus to regenerate chelate $Fe^{2+}$ as a developing agent. Because the developing agent used for development is regenerated by the current conduction process as described above, not only can the ability of the developing solution be prevented from deteriorating, but the ability of the developing solution lowered by aeration and by treatment of the light-sensitive material can be recovered as long as the current conduction process is continuously carried out in the auxiliary tank from which the supplementary solution is supplied. Accordingly, the above-mentioned effects can be easily achieved if the supplementary solution is supplied to the developing solution in a quantity sufficient only to compensate for developing solution lost due to evaporation and developing solution lost due to adherence to the light-sensitive material. That is, the necessary quantity of the supplementary solution can be extremely reduced. Furthermore, the developing solution recovering function can be provided easily with only relatively minor changes to the conventional apparatus and without any significant increase in the size thereof by carrying out the current conduction process using the auxiliary tank which has been conventionally used for supplying the supplementary solution or for circulating developing solution.

The nozzle for supplying supplementary solution to the auxiliary tank extends downward relative to the liquid surface. The opening end portion of the nozzle may be located obliquely with respect to the liquid surface or may have a vertical slit. Furthermore, the opening end portion of the nozzle is in contact with the liquid surface. The supplementary solution ejected from the nozzle partly flows onto the liquid surface and partly is directly supplied into the liquid. The flow of the supplementary solution onto the liquid surface is based on the action of a component force with respect to the direction of an axis of the nozzle which is originally the direction of supplementation. Also the force in the part of the supplementary solution directly supplied into the liquid is small because the component force decreases. Accordingly, both the flowing part of the supplementary solution and the part of the supplementary solution directly supplied into the liquid are not subjected to intensive forces. Accordingly, liquid drops of the supplementary solution are prevented from being deposited on the inner wall of the auxiliary tank, so that the inner wall is protected from staining. Furthermore, even in the case where another auxiliary tank is provided adjacent the auxiliary tank, mixing of the supplementary solution into the other auxiliary tank caused by scattering of the supplementary solution can be avoided.

By separating the developing tank by a anion-exchange membrane and providing electrodes at opposite sides with respect to the anion-exchange membrane, $Br^-$ eluted from the light-sensitive material is concentrated at the anode so that bromine gas is discharged from the liquid into air as represented by $2Br^- \rightarrow Br_2$, if the anode-side electrolytic solution has a suitable property. If the bromine gas can be caught and removed intermediately, an offensive odor can be prevented from being emitted out. Accordingly, $Br^-$, which is unnecessary matter, is not accumulated in the developing solution, so that overflowing of the treatment solution for removing such unnecessary matter is not required. As a result, less waste fluid is produced.

Because it is preferable that reduction and recovering of developing agents and preservatives subjected to aeration be finished at the time of the starting of the developing treatment, the current conduction process is preferably carried out before the developing treatment is started. Because the oxidation-reduction potential changes with the current conduction process, whether or not the developing solution has been regenerated sufficiently for the developing treatment can be judged by detecting the oxidation-reduction potential. Further, optimum current conduction can be achieved by controlling the quantity of current conduction through detection of the oxidation-reduction potential in the current conduction process. The oxidation-reduction potential can be controlled with the use of an electrometer, a voltage control device, current control device, or the like.

The septum used in the current conduction process has a function of permitting cations or anions to selectively pass therethrough. However, foreign particles may be deposited on the septum by convection caused by the passage of ions. The septum has fine mesh-like transmissible pores through which ions can be transmitted. When the transmissible pores are blocked by deposition of foreign matter on the septum, however, the transmission of ions is partly cut off so that the regenerating efficiency is lowered. To compensate the lowering of efficiency, the current conduction time may be increased or the applied current or voltage applied increased. To carry out this measure by sample control, it is preferable that the lowering of current conduction efficiency $\eta$ be controlled as a function of the time of use T so that the current conduction time t is thereafter controlled on the basis of the use time T.

Specifically, because the current conduction efficiency $\eta$ decreases as the use time T increases, the current conduction time t is also increased correspondingly to the increase of the use time T to thereby compensate the lowering of current conduction efficiency $\eta$. Because the lowering of current conduction efficiency $\eta$ is compensated by the current conduction time t, it is unnecessary to increase the total quantity of current conduction with respect to the developing solution. That is, the current conduction time t is controlled without increase of the total quantity of current conduction so that the product of current conduction efficiency q and current conduction time t is kept constant. As a result, even in the case where the current conduction efficiency $\eta$ is lowered by long-term treatment, the current conduction time t in the regenerating treatment increases correspondingly to the lowering of current conduction efficiency, so that a constant regeneration state can be maintained continuously.

It is troublesome to detect the state of lowering of current conduction efficiency $\eta$ on a continuous basis. Accordingly, the state of lowering of current conduction efficiency $\eta$ corresponding to the use time T is preliminarily experimentally measured and stored as a look-up table so that the experimental result can be referred to at each time. Accordingly, means of detecting the state of current conduction efficiency $\eta$ is not required specifically as long as means for calculating use time T and for storing the use time T can be provided.

Although a conventional treatment apparatus can be used in the practice of the present invention wherein the current conduction process is applied using the auxiliary tank of the treatment apparatus, the same process can be applied to the case where the auxiliary tank is not used. For example, in the conventional treatment apparatus piping for circulating the treatment solution is provided together with the auxiliary tank. A detachable current conduction cartridge may be formed in the piping.

The above-described current conduction cartridge includes a tank into which a treatment solution to be regenerated is introduced, and a tank filled with an electrolytic solution. These tanks are arranged so that the treatment solution in one tank is in contact with the treatment solution in the other tank through a septum. Different-polarity electrodes are provided in contact with the respective solutions, so that the treatment solutions can be subjected to the current conduction process by applying a voltage between the two electrodes. In the case where the detachable current conduction cartridge is provided, silver precipitated on the cathode when the ability of the fixing solution is recovered by applying the current conduction process to the fixing solution can be collected easily.

With respect to tank structure, for example, two tanks may be connected to each other through a septum or, for example, two tanks may be provided so that one tank is used as an outer tank and the other as an inner tank enclosed in the outer tank, and a part of the inner tank is provided with a septum through which the two solutions can contact each other.

Furthermore, if the current conduction cartridge has a structure in which the current conduction cartridge can be separated with the septum as a boundary, the collection of silver can be carried out more easily, and at the same time both cleaning and inspection can be made easier. With respect to the collection of silver, if the cathode is formed in a cylindrical shape, the surface area of the electrode can be increased so that not only can the collecting efficiency be improved but silver can be easily dislodged from the cathode.

At the anode, bromine gas is produced from bromine ions and dispersed from the inside of liquid by the current conduction process. It is necessary to trap the bromine gas so as to no allow it to escape into air for the purpose of protecting the environment. If the quantity of current conduction is increased, a large quantity of bromine gas is produced, while the pH of the developing solution is increased by the current conduction process. Accordingly, it is preferable that pH off the developing solution be controlled properly. The pH of the developing solution is preferably from 2 to 8 and, more preferably, from 3 to 7. A suitable amount of an acidic or alkaline solution is supplied to the developing solution so that pH thereof is in the above-mentioned range.

The above-mentioned control of oxidation-reduction potential and pH is more effective in the case where the treatment tank used for development is of a type having only a small opening degree, or is of a sealed type to reduce oxidation of the developing solution by the air so that good treatment conditions can be maintained for a long time. For example, treatment apparatuses described in Japanese Patent Unexamined Publications Nos. Hei-2-84642, Hei-2-68548 and Hei-2-69744 can be used. In the case where the quantity of liquid is smaller, the control of oxidation-reduction potential and pH can be performed with high accuracy. In this respect, for example, the above-mentioned control is suitable for slit treatment in which the sectional form of a treatment portion of the light-sensitive material is substantially a slit-like narrow path.

It is further preferable that the contact area of the developing tank with the air is as small as possible. Specifically, a low opening degree type treatment tank or a sealed type treatment tank described in Japanese Patent Unexamined Publications Nos. Hei-2-69744 and Hei-2-84642, and the like, is preferred. The terminology "low opening degree" as used herein means $K=S/V$ satisfying the following relation:

$$\log K < -1.8\times10^{-5}\,V - 1.5$$

where S represents the surface area ($cm^2$) of a liquid surface portion, V represents the volume ($cm^3$), and K represents the opening degree S/V ($cm^{-1}$).

When the current conduction process is applied to the fixing solution, a reaction in which a fixing agent and preservatives oxidized by aeration are reduced on an electrode (cathode) occurs, so that not only are sulfides prevented from being produced, but the stability of fixing increases. Furthermore, silver in the liquid is precipitated on the cathode, so that the fixing agent is regenerated. As a result, failure of desilverization is prevented. In some cases, the quantity of the fixing agent used can be reduced. Not only in the case where a fixing solution for monochrome is used, but also in the case where a fixing solution for color is used, the fixing solution can be regenerated.

It is preferable that an anion-exchange membrane be used as the septum.

By providing a an anion-exchange membrane between a developing solution and an electrolytic solution, halide ions such as $Br^-$ accumulated in a color developing solution by development can selectively pass through the cation-exchange membrane whereby unnecessary halide ions are prevented from being accumulated in the color developing solution, so that inhibition of development is prevented from occurring. Accordingly, a process for removing unnecessary halide ions by overflowing or other means is not required, so that both the quantity of waste fluid and the quantity of supplementary solution can be reduced.

By providing an anion-exchange membrane between a fixing solution and an electrolytic solution, halide ions such as $Br^-$ accumulated in the fixing solution by fixing treatment can selectively pass through the anion-exchange membrane so that unnecessary halide ions are prevented from being accumulated in the fixing solution, whereby inhibition of fixing is prevented from occurring. On the other hand, silver is precipitated from the fixing solution so as to be out of system so that the fixing agent is regenerated.

In general, a solution containing a chelating agent is preferably used as the developing solution in the current conduction process. This is because such a solution is suitable for the double purpose of preventing precipitation of components due to movement of matter and preventing precipitation due to the presence of certain substances (such as calcium) in the liquid. Furthermore, in the case where the developing solution contains metallic ions capable of being oxidized and reduced easily, the developing solution is more effective for preventing unnecessary reaction on the electrodes. In this case, it is preferable that a chelating agent having theoretical metallic ion chelating activity of not less than 1.1 mol with respect to metallic ion is contained in the liquid. The metallic ion chelating activity is preferably not less than 1.5 mol and, more preferably, not less than 2.0 mol. That is, the chelating agent is preferably present in an excessive amount with respect to metallic ions. This is for the purposes of preventing precipitation of metal, preventing precipitation of calcium in the liquid, and preventing precipitation due to matter passing through the cation-exchange membrane.

Because in this case it is not preferable that the electrolytic solution move to the developing solution side, a chelating agent higher in molecular weight is preferably used as the chelating agent. It is further preferable that the chelating agent be stable to metallic ions. The molecular weight of the chelating agent is preferably from 400 to 1,000,000. This reason is as follows. If the molecular weight is higher than 1,000,000, the chelating agent is water-insoluble. If the molecular weight is lower than 400, the chelating agent passes through the anion-exchange membrane.

The stability constant (production constant; log k) representing the stability of the chelating agent to metallic ion is preferably from 2.0 to 40.0. Examples of the metals to be used in combination with the chelating agent include iron, aluminum, titanium, nickel, and cobalt, which are readily available and relatively stable metals.

In the case where the electrolytic solution is used in the anode side, a small amount of acid is produced by applying a current to the electrolytic solution. Therefore, an alkaline buffer solution may be preliminarily added to the electrolytic solution. On the contrary, in the case where the electrolytic solution is used on the cathode side, alkali is produced. Therefore, an acidic buffer solution may be preliminarily added to the supplementary solution.

The current conduction process according to the present invention is substantially a treatment process in which a current is applied between a cathode and an anode provided through a anion-exchange membrane separating a part of a treatment tank, by which unnecessary or necessary matter is moved to a desired side through the anion-exchange membrane and, at the same time, oxidation or reduction of liquid components is performed by reaction on electrode surfaces.

In accordance with Faraday's law, the number of ions moving through the anion-exchange membrane by electrode reaction and from an ionic compound is proportional to the quantity of current flowing in the electrode surfaces. To produce this current, a voltage is applied between the electrodes. The voltage is generally from 0.1 to 10 V, preferably, from 0.3 to 5 V. If the voltage is lower than the lower limit, no current is produced. If the voltage is higher than the upper limit, unnecessary electrode reaction occurs so that reaction efficiency (current efficiency) for objective matter is lowered.

Accordingly, if a constant-current electric source is used, the current conduction process can be properly controlled using only time control. The method using a constant-current electric source is, however, unsuitable to the case where the electric source can sometimes be unexpectedly cut off, such as in the event of power failure or temporary suspension of electric power, because it is difficult to reset the current level. In addition, a constant-current electric source is generally expensive. Accordingly, an inexpensive as possible electric source (battery, secondary battery, or the like) is preferably used.

In the case where a battery or a secondary battery is used as the electric source, the current will drop when the voltage falls off at the end of the battery's charge, making current control difficult. In this case, it is necessary to apply a current so that the product of current value and time is kept constant with respect to a predetermined quantity of treatment of the light-sensitive material. The product of current and time is obtained by measuring the accumulated quantity of current using an integrating ammeter. In the case where a constant-current electric source is used, any one of various available ammeters can be used. In this case, only the time during which a current flows in the ammeter must be accumulated. On the contrary, in the case where an electric source other than a constant-current electric source is used, an available coulomb meter or an integrating ammeter can be used.

For example, by applying a current so that a predetermined amount of charge is applied to the developing solution for treatment of one photographic film, the developing solution can be regenerated properly.

In an automatic developing apparatus having a large number of treatment tanks to be subjected to current conduction processes, electric source costs can be reduced by staggering the time for the use of the various current conduction processes.

If the anion-exchange membrane is used continuously, the membrane resistance may increase due to clogging of the membrane or the like. In this case, if an attempt to obtain a constant value of current is made, the applied voltage may increase undesirably. In order to eliminate this disadvantage, it is necessary to keep the membrane resistance not higher than a predetermined value. On the contrary, if a constant voltage is applied, the value of current successively decreases as the membrane resistance increases. In such a case, the current conduction process can be properly performed if the product of current and time is controlled so as to be kept constant with respect to the predetermined quantity of treatment of the light-sensitive material.

As described above, the current conduction process can be controlled on the basis of the quantity of current according to Faraday's law but, in some cases, the change of bulk potential of the developing solution may be detected so that the quantity of current conduction may be determined on the basis of the change of bulk potential and the quantity of current. In such a case, a fuzzy judgment may be made by a control device.

In measuring the oxidation-reduction bulk potential of the developing solution, oxidation-reduction potential measuring apparatuses as described in Japanese Patent Unexamined Publications Nos. Sho-60-195544 and Sho-60-195545 may be used. Furthermore, this potential can be detected and controlled using a control method described in Japanese Patent Unexamined Publications Nos. Sho-60-195544 and Sho-60-195545.

For example, in the case of a developing solution, current conduction is controlled so that the oxidation-reduction potential is in a predetermined range. If the oxidation-reduction potential exceeds a preset upper limit, current conduction is stopped so that oxidation of the developing solution is stopped. As the light-sensitive material is treated in the period when current conduction is stopped, the oxidation-reduction potential of the developing solution decreases. If the oxidation-reduction potential becomes lower than a lower limit, current conduction is restarted to oxidize the developing solution to thereby increase the potential.

In the present invention, current conduction is preferably carried out before treatment or in a treatment period so that the developing activity can be maintained during treatment. At the same time treatment is finished, that is, when, for example, a signal indicating completion of treatment of the light-sensitive material S is received, current conduction may be terminated.

Examples of metals constituting a metallic compound used as a developing agent in above process are transition metals such as Ti, V, Cr, Fe, etc., having properties such that each metal can turn to several different oxidation states. Accordingly, a metallic compound in a lower oxidation state than the maximum oxidation state is theoretically used as a developing agent so that the reducing force thereof can be utilized. In general, $Ti^{3+}$ is used as Ti, $V^{2+}$ as V, $Cr^{2+}$ as Cr, and $Fe^{2+}$ as T. Among these, Ti, Fe, etc., are preferably used.

The metallic compound is generally provided in the form of a salt, or may be provided in the form of a complex. Examples of the metallic compound as salt include halides such as chlorides, bromides, and iodides; oxalates; sulfates; acetates; citrates; and the like. Specific examples thereof include $TiCl_3$, $TiBr_3$, $TiI_3$, $FeCl_2$, $FeBr_2$, $VCl_2$, $V(SO_4)$, $Fe(COO)_2$, $FeSO_4$, $Fe(CH_3COO)_2$ iron(II) citrate, and the like. The complex used preferably has $Ti_{3+}$ or $Fe^{2+}$ as a center metal and has a multidentate ligand as its ligand. Specific examples of this ligand include amino-polycarboxylic acids and salts thereof such as ethylene diamine tetraacetic acid (EDTA), diethylene triamine pentaacetic acid (DTPA), etc.; amino-polyphosphoric acids and salts thereof such as ethylene-diamine-N,N,N',N'-tetramethylene-phosphoric acid, 1,3-diaminopropanol-N,N,N',N'-tetramethylene-phosphoric acid, etc.; carboxylic acids and salts thereof such as nitrilotriacetic acid, oxalic acid, citric acid, etc.; phosphoric acids and salts thereof such as nitrilo-N,N,N-trimethylene-phosphoric acid, propylamino-N,N-dimethylene-phosphoric acid, etc.; and the like.

Among these, a complex having EDTA, DTPA, or the like, as a ligand is used preferably.

The complex may be formed in the developing solution by a method of adding a metal salt and a ligand compound thereto. This method is preferred in the present invention.

Details of this type metallic compound can be found by referring to Japanese Patent Postexamination Publication No. Sho-54-41899 and the reference literature cited therein. The metallic compound content of the developing solution is from 1 to 100 g/liter and, preferably, from 5 to 50 g/liter.

Various additives such as a pH buffer, antifogging agent, and the like, may be used, contained in the above-mentioned developing solution. These types of additives are described in Japanese Patent Postexamination Publication No. Sho-54-41899 and the like. The developing solution is used in a pH range of from 0.5 to 11, preferably, from 1 to 11, more preferably, from 2.5 to 9.

The present invention may be further applied to a general hydroquinone type monochrome developing solution or to a color developing solution using a paraaminophenol derivative. The invention may be further applied to a fixing solution or to a bleaching solution if necessary.

An electric conductor or semiconductor may be used as the cathode in the present invention as long as it is durable for long-term use. Particularly, stainless steel is preferred. Any material can be used as the anode as long as it is an insoluble and electrical conductor. Specific examples of the material for the anode include carbon (graphite), lead dioxide, platinum, gold, titanium, and copper. In some cases, stainless steel may be used as the material. The preferred form of each of the two electrodes is a plate form, netted plate form or projection-including plate form in which the electrodes can be easily provided in tanks. Any suitable size can be selected in accordance with the tank volume.

Any cation-exchange membrane can be used in the present invention as long as it can transmit cations selectively. An available anion-exchange membrane may be used directly.

In this case, the anion-exchange membrane can be selected corresponding to the valency of anions to be moved through the anion-exchange membrane. For example, for the purpose of transmitting halide ions such as $Br^-$ accumulated in the developing solution, a anion-exchange membrane capable of selectively transmitting monovalent anions may be used.

Examples of the septum used for forming a current conduction chamber to be subjected to the current conduction process in the present invention include anion-exchange membranes, anion-exchange membranes, and other transmissible membranes. Of these, the preferred are cation-exchange membranes. Any anion-exchange membrane can be used or an available anion-exchange membrane can be used as long as it can transmit anions selectively. Examples of the cation-exchange membrane used in the invention include Selemion AWV/AMR (made by Asahi Glass Co., Ltd.), Acipex A201 and A172 (made by Asahi Chemical Industry Co., Ltd.), Neosepta AM-1 to AM-3 (made by Tokuyama Soda Co., Ltd.), Ionac MA-3148 (made by Ionac Chemicals), Nepton AR103PZL (made by Ionics), etc. Particularly in the case where the current conduction chamber to be subjected to the current conduction process is provided in a color developing tank, available anion-exchange membranes tradenamed Selemion ASV/ASR (made by Asahi Glass Co., Ltd.), Neosepta AFN-7, Neosepta ACS (made by Tokuyama Soda Co., Ltd.), etc., capable of selectively transmitting monovalent anions may be preferably used for transmitting halide ions such as $Br^-$.

Examples of the transmissible membrane include Yumicron Separator (made by Yuasa Battery Co., Ltd.); solid electrolyte walls described at pages 125 to 132 of "Fine Electronics and High-Function Materials" by Torao Higaki (issued by CMC, 1983); porous polymer plates (for example, porous film or fabric of xanthone), and porous polyester fabric (for example, the tradenamed product Wellkey produced by Teijin, Ltd.); and walls of foam materials such as urethane, polyethylene, polypropylene, etc.

The "anion-exchange membrane" in the present invention is a generic name for membranes capable of selectively transmitting anions. In this sense, this concept includes membrane-shaped materials of porous ceramics with a pore size of from 0.2 to 20 $\mu$m.

An good electrical conductor or a semiconductor may be used as the cathode, which is one of the electrodes and is used for current conduction, as long as it is durable for long-term use. Examples thereof include metal materials such as stainless steel, aluminum, silver, nickel, copper, zinc, brass, titanium, etc. Particularly, stainless steel is preferred. Any material can be used as the anode as long as it is insoluble and a good electrical conductor. Specific examples thereof include carbon (graphite), lead dioxide, platinum, gold, and titanium steel. In some cases, stainless steel may be used as the material. The preferred form in each of the two electrodes is sa plate form, netted plate form, or projection-including plate form in which the electrodes can be easily provided in tanks. Any suitable size can be selected as the electrode size depending on the tank volume. Furthermore, the plate-like electrodes may be made very thin to impart flexibility to the electrodes so that not only can they be rolled easily, but the operation of immersing them in liquid or the operation of picking up them into air can be performed easily. By such structure, the effective area of an electrode can be adjusted through adjustment of the depth of the electrode immersed in liquid.

The electrolytic solution used in the present invention is not limited specifically. Examples of the electrolyte preferably used include halides such as NaCl, KCl, LiCl, NaBr, KBr, KI, etc.; sulfates such as $Na_2SO_4$, $K_2SO_4$, etc.; nitrates such as $KNO_3$, $NaNO_3$, $NH_4NO_3$, etc.; carbonates such as $Na_2CO_3$, $K_2CO_3$, etc.; and the like. The electrolyte concentration in the electrolytic solution is from 0.01 to 30% and, preferably, from 0.01 to 20%. As another electrolytic solution, a solution obtained by diluting the fixing solution may be used.

Although the above description relates to the case where the electrolytic solution is prepared newly, the invention can be applied to the case where a liquid obtained by overflowing of a rinsing solution or a liquid obtained by overflowing of a treatment solution used in current conduction may be used as the electrolytic solution.

Even in the case where ion-exchange water is used as the rinsing solution, salt, which is a component of the fixing solution carried by the light-sensitive material S, is mixed into the rising solution so that the rinsing solution after use contains the salt. Accordingly, the solution overflowing from the rinsing solution can be used as an electrolytic solution without any trouble. As a result, the quantity of waste fluid can be reduced.

An available rinsing solution can be used as the rinsing solution. Preferably, a solution containing additives such as microbicide, fungicide, coloring matter eluting agent, decoloring agent, etc., is used as the rinsing solution.

Not only is the present invention applicable to treatment using a developing solution containing a metallic compound as a developing agent, but the invention may also be applied to treatment using a general monochrome developing solution. That is, in the case where semiquinone is produced from hydroquinone by aeration or by development of silver halide, the semiquinone can be regenerated to hydroquinone by current conduction. Further, in the case where semiquinone is oxidized to quinone, a part of the quinone can be oxidized to hydroquinone by current conduction.

Further, the monochrome developing solution contains a relatively large amount of sulfite preservatives, so that particularly there is a tendency for silver staining to be caused by the sulfite preservatives. However, since silver is precipitated on the cathode, silver staining is prevented from occurring. On the other hand, silver is precipitated also in the fixing solution, so that collection of silver can be effected.

In the same generally manner as described above, a regenerating function due to current conduction is a part of the reaction mechanism. Accordingly, any one of various monochrome and color light-sensitive materials may be used as the light-sensitive material in the present invention. Examples of the light-sensitive material include monochrome negative film, monochrome printing paper, monochrome reversal film, monochrome reversal printing paper, monochrome positive film, plate-making photographic light-sensitive material, X-ray photographic light-sensitive material, micro light-sensitive material, color negative film, color reversal film, color printing paper, color positive film, color reversal printing paper, etc.

In the present invention, a general monochrome developing solution, in which the above-mentioned metallic compound is not used as a developing agent, contains hydroquinones such as hydroquinone, etc., as a main developing agent. From the point of view of good performance, a combination of hydroquinones and 1-phenol-3-pyrazolidones or a combination of hydroquinones and p-aminophenols may be preferably used. Further, a color developing agent employing paraaminophenol derivatives may be used.

The hydroquinone type developing agent is used generally in an amount of from 0.01 to 1.5 mol/liter, preferably, in an amount of from 0.05 to 1.2 mol/liter.

In addition to this, the p-aminophenol type developing agent or the 3-pyrazolidone type developing agent is used generally in an amount of from 0.0005 to 0.2 mol/liter, preferably, in an amount of from 0.001 to 0.1 mol/liter.

Examples of the sulfite preservatives used in the above-mentioned monochrome developing solution include sodium sulfite, potassium sulfite, lithium sulfite, ammonium sulfite, sodium hydrogensulfite, potassium metahydrogensulfite, etc. The sulfite content is not smaller than 0.2 mol/liter, preferably, not smaller than 0.4 mol/liter. The upper limit of the sulfite content is preferably 2.5 mol/liter.

The pH range of the monochrome developing solution is preferably from 8.5 to 13 and, more preferably, from 9 to 12.

The fixing solution used for fixing treatment after developing treatment of the monochrome light-sensitive material in the present invention is an aqueous solution containing a fixing agent and having a pH of not lower than 3.8, preferably, a pH of from 4.2 to 7.0.

Examples of the fixing agent include sodium thiosulfate, ammonium thiosulfate, etc. From the point of view of fixing speed, ammonium thiosulfate is particularly preferred. The quantity of the fixing agent to be used can be set suitably, and is generally from about 0.1 to about 3 mol/liter.

The fixing solution may contain water-soluble aluminum salt which serves as a hardening agent. Examples of the aluminum salt include aluminum chloride, aluminum sulfate, potassium alum, etc.

In the fixing solution, tartaric acid, citric acid, gluconic acid and derivatives thereof may be used singly or in combination. A fixing solution containing these compounds in an amount of not smaller than 0.005 mol per liter of the fixing solution is effective. Particularly, a fixing solution containing these compounds in an amount of 0.01 to 0.03 mol/liter is more effective.

If necessary, the fixing solution may contain preservatives (for example, sulfite, hydrogensulfite), a pH buffer agent (for example, acetic acid, boric acid), a pH adjusting agent (for example, sulfuric acid), a chelating agent having hard water softening activity, and compounds described in Japanese Patent Unexamined Publication No. Sho-62-78551.

In treatment of the monochrome light-sensitive material, a rinsing treatment is carried out after the fixing treatment. The rinsing solution having a function of removing the treatment agent remaining in the previous process is substantially the same as a washing solution or washing liquid.

In the rinsing treatment, a quantity of supplementation of not larger than 3 liters per 1 $m^2$ of the light-sensitive material can be employed. In this case, a fungicide treatment is preferably applied to the rinsing solution.

Examples of the fungicide treatment used in the invention include an ultraviolet radiation method as described in Japanese Patent Unexamined Publication No. Sho-60-263939, a method using magnetic fields as described in Japanese Patent Unexamined Publication No. Sho-60-263940, a method for purifying water using an ion-exchange resin and a method for blowing-in of ozone as described in Japanese Patent Unexamined Publication No. Sho-61131632, and a method using microbicide described in Japanese Patent Unexamined Publications Nos. Sho-62-115154, Sho-62-153952, Sho-62-220951, Sho-62-209532 and Hei-1-91533.

Further, microbicides, fungicides, surface-active agents, etc., described in L. F. West, "Water Quality Criteria," Photo. Sci. & Eng., Vol. 9, No. 6 (1965), M. W. Beach, "Microbiological Growths in Motion-picture Processing" SMPTE Journal Vol. 85, (1976), R. O. Deegan, "Photo Processing Wash Water Biocides," J. Imaging Tech. 10, No. 6 (1984), and Japanese Patent Unexamined Publications Nos. Sho-57-8542, Sho-57-58143, Sho-58-105145, Sho-57-132146, Sho-58-18631, Sho-57-97530, Sho-57-157244, etc., may be used in combination.

Further, isothiazoline compounds as described in R. T. Kreiman, J. Image. Tech. 10, (6), page 242 (1984), isothiazoline compounds as described in Research Disclosure, Vol. 205, No. 20526 (May, 1981), isothiazoline compounds as described in Research Disclosure, Vol. 228, No. 22845 (April, 1981), compounds as described in Japanese Patent Unexamined Publication No. Sho-62-209532, etc., may be used as microbicides in combination.

Other compounds as described in "Chemistry of Antibacterial and Antifungal Agents" by Hiroshi Horiguchi, Sankyo Shuppan (1982), and "Antibacterial and Antifungal Agents Technical Handbook", the Society of Antibacterial and Antifungal Agents, Japan, Gihodo (1986), may be contained.

In the treatment of the monochrome light-sensitive material, a stabilizing solution may be further used.

Details of the treatment of the monochrome light-sensitive material can be found by referring to Japanese Patent Unexamined Publications Nos. Hei-1-93737, Hei-1-250947, Hei-2-103035, Hei-2-103037, Hei-2-401260, Sho-61-267559, etc.

The above description concerning the monochrome light-sensitive material is also substantially applied to a fixing solution and a rising solution used in the treatment of the color light-sensitive material. Details of the treatment of the color light-sensitive material can be found by referring to the description in Japanese Patent Unexamined Publications Nos. Sho-63-70857, Hei-1-190889, Hei-1-198754, Hei-1-106050, etc.

Details of monochrome/color light-sensitive materials which can be treated according to the present invention are disclosed in Japanese Patent Unexamined Publication No. Hei-1-259359, the above-mentioned patent literature, etc.

DESCRIPTION OF THE PREFERRED EMBODIMENTS

Preferred embodiments of the present invention will be described below with reference to the accompanying drawings.

Figure 1:
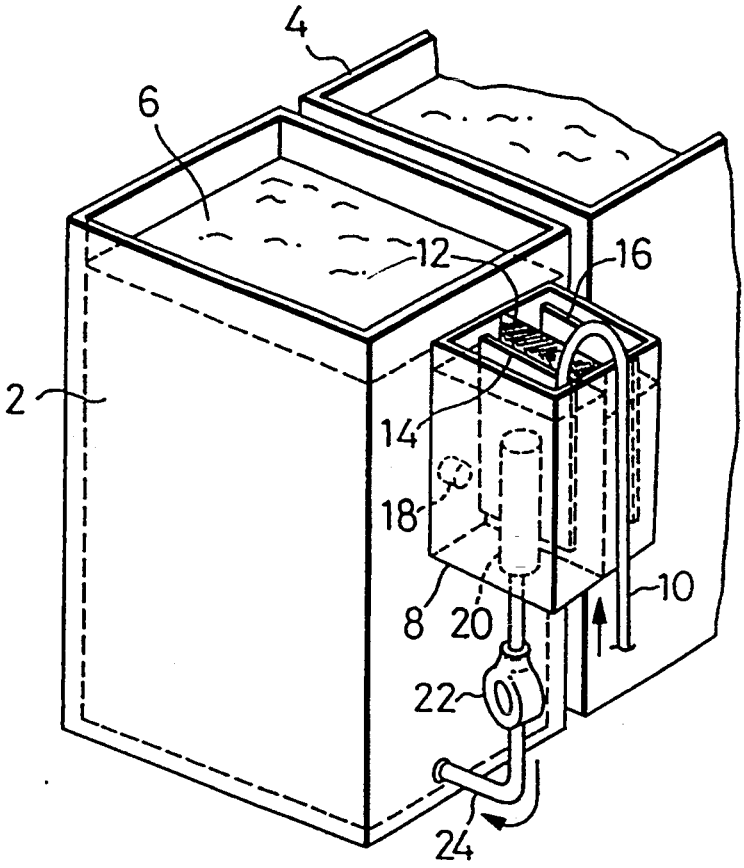
FIG. 1 is a perspective view of a developing tank portion of a light-sensitive material treatment apparatus.

FIG. 1 is a perspective view showing a developing tank in a monochrome photographic light-sensitive material treatment apparatus constructed in accordance with a preferred embodiment of the present invention. A fixing tank 4 and a washing tank (not shown) are arranged so as to be continuous with the developing tank 2.

The developing tank 2 is filled with a developing solution 6 for treating a light-sensitive material. An auxiliary tank 8 is provided adjacent the developing tank 2. The auxiliary tank 8 is used for supplying a supplementary solution to recover the developing ability of developing solution 6 which has deteriorated. A nozzle 10 extends from a supplementary solution tank (not shown). The auxiliary tank 8 is separated into two chambers by a anion-exchange membrane 12 as a septum, so that one chamber is filled with a developing solution and the other chamber is filled with an electrolytic solution. A cathode 14 in contact with the developing solution in the auxiliary tank 8 and an anode 16 in contact with the electrolytic solution in the auxiliary tank 8 are arranged so that a current can be applied between the two electrodes 14 and 16.

The developing solution-side chamber in the auxiliary tank 8 is communicated with the developing tank 2 so that the developing solution flowing from the developing tank 2 into the chamber through a pipe 18 flows back to the developing tank 2 through a filter 20, a pump 22 and a pipe 24, that is, the developing solution circulates. On the other hand, the electrolytic solution-side chamber is formed so that a treatment solution overflowing from another treatment tank such as a fixing tank or a washing tank can flow into the chamber. The overflowing treatment solution is used as a solution for supplementing the electrolytic solution. An overflow port of the electrolytic solution-side chamber is lower by a distance of 5 mm to 100 mm than the liquid surface of the developing solution-side chamber. Accordingly, an advantage arises in the case where the overflowing part of the developing solution is reused as an electrolytic solution. Furthermore, because the liquid surface of the electrolytic solution is sufficiently low that the liquid pressure of the anion-exchange membrane 12 is lowered, and because the absolute liquid surface of the electrolytic solution is low, the electrolytic solution is hardly mixed into the developing solution.

A developing agent contained in the developing solution flowing from the developing tank 2 into the auxiliary tank 8 is oxidized by the developing of the light-sensitive material and by contact with air, and is reduced by electronation from the cathode 14 in the auxiliary tank 8 so that the main developing agent is reused. When, for example, a chelate Fe(II) compound is used as the developing agent, chelate $Fe^{2+}$ is oxidized by treatment of the light-sensitive material and by contact with air to thereby form chelate $Fe^{+3}$. This chelate $Fe^{+3}$ has no developing ability, but it is returned to chelate $Fe^{2+}$ by electronation from the cathode 14 so that the developing ability can be recovered. The reaction $Fe^{3+} + e^- \rightarrow Fe^{2+}$ occurs continuously on a surface of the cathode 14 in the auxiliary tank 8, so that $Fe^{2+}$ is regenerated continuously. As a result, the deteriorated developing solution is regenerated so that the ability of the developing solution is recovered.

$Br^-$ eluted from the light-sensitive material into the developing solution with the above-mentioned regenerating reaction moves toward the anode 16. $Br^-$ is a substance unnecessary for development. When a large amount of $Br^-$ is accumulated in the developing solution, a failure in development occurs. However, $Br^-$ can be removed from the developing solution by current conduction because $Br^-$ is moved from the developing solution to tile electrolytic solution by current conduction. Also in this respect, the developing solution can be regenerated. The reaction $2Br^- \rightarrow Br_2$ occurs on the surface of the anode, so that bromine gas is discharged from the inside of the electrolytic solution. Because the bromine gas is harmful to health and the environment if it is released into the atmosphere directly, it is preferable that the bromine gas be trapped on the liquid surface.

Because not only regeneration of the developing solution due to current conduction but recovery of the ability due to the supply of the supplementary solution can be performed in the auxiliary tank 8, the developing solution flowing out of the auxiliary tank 8 through the pump 22 is very excellent in developing ability.

Briefly describing the supply of the supplementary solution, the solution for supplementing the developing solution mainly contains an agent component to compensate the developing agent which has deteriorated and been oxidized. A predetermined amount of the agent component is continuously supplied in an amount corresponding to the quantity of treatment of the light-sensitive material.

Figure 2A:
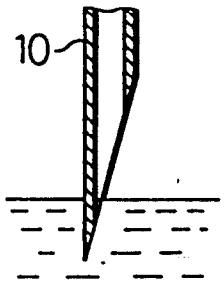
FIG. 2A is a sectional view of an end of a nozzle, showing an opening end portion formed obliquely.
Figure 2B:
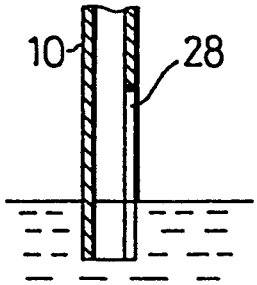
FIG. 2B is a sectional view of an end of a nozzle, showing an opening end portion having a slit.

FIGS. 2A and 2B are sectional views respectively showing examples of an end portion of the nozzle. The nozzles shown in FIGS. 2A and 2B are different in the opening shape of the end of the nozzle 10. The nozzle 10 shown in FIG. 2A is formed by obliquely cutting an end of a hollow cylindrical tube. The nozzle 10 shown in FIG. 2B is formed by providing a slit 28 vertically in an end of a hollow cylindrical tube. In each example, the nozzle 10 extends downward to a liquid surface so that the opening end portion of the nozzle 10 is partly in contact with the developing solution.

The shape and setting position of the nozzle 10 are constructed to prevent the supplementary solution and the developing solution from spattering at the time of supplementation. If the opening end portion of the nozzle 10 is entirely placed in air, the supplementary solution and the developing solution may spatter, and the spattering of the solutions causes depositing of the solutions on the walls of the auxiliary tank or mixing of the solutions into an adjacent auxiliary tank. If the opening end portion of the nozzle 10 is entirely immersed in liquid, the treatment solution may flow backward corresponding to the form of the supplementing pump or the supplementary solution, and the developing solution may spatter due to the energy of the supplementary solution supplied together with air so that deposition of the solutions on the walls of the auxiliary tank and mixing of the solutions into the auxiliary tank are caused. Water is evaporated from the deposited auxiliary solution and developing solution, so that components of the solutions are precipitated. This precipitation causes both stain and misoperation in the current conduction process and supplementing treatment.

In the case where the opening end portion of the nozzle 10 is partly immersed in the developing solution in the manner described above, not only can scattering of the developing solution caused by mixing of air into the developing solution be avoided, but energetic striking of the supplementary solution to the liquid surface also can be avoided. That is, when the opening end portion is partly in liquid and partly in air, a part of the supplementary solution is ejected from the nozzle 10 at the opening portion in air to thereby weaken the energy of the supplementary solution. Accordingly, both the energy of the supplementary solution indirectly supplied in air and the energy of the supplementary solution directly supplied in liquid are weakened so that scattering of the supplementary solution and developing solution can be avoided.

Figure 3A:
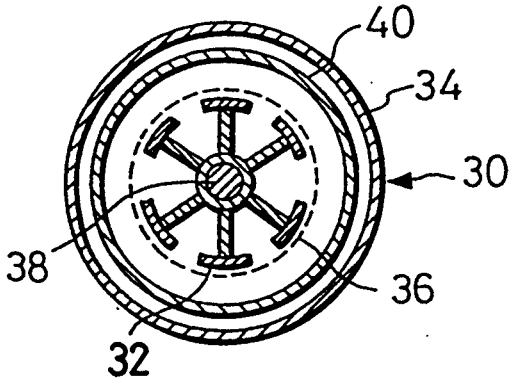
FIG. 3A is a transverse sectional view of a current conduction tank.
Figure 3B:
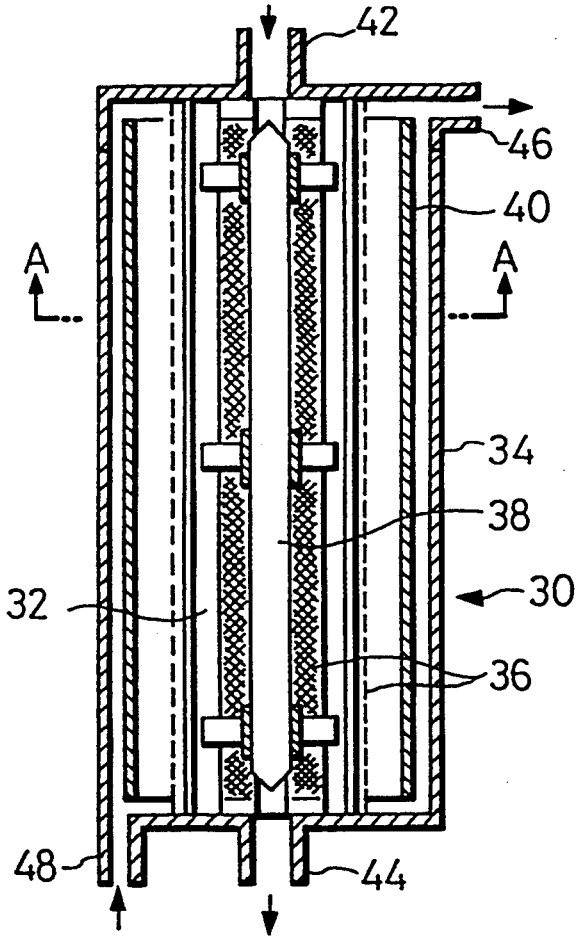
FIG. 3B is a longitudinal sectional view of the current conduction tank.

FIGS. 3A and 3B are sectional views of a modified example of the current conduction tank 30 used in regeneration of the fixing solution. FIG. 3A is a sectional view taken along the line A—A in FIG. 3B.

The current conduction tank 30 includes an inner tank 32 and an outer tank 34. The inner tank 32 has a plurality of long members which are supported in the form of a hollow cylinder so that concentric openings are formed between respective ones of the members. An anion-exchange membrane 36 is provided along the circumference of the inner tank 32 to thereby make it possible to put the fixing solution into the inner tank 32. The outer tank 34, which is shaped like a hollow cylinder, is filled with the electrolytic solution between the anion-exchange membrane 36 and the circumference of the outer tank 34. The fixing solution and the electrolytic solution are in contact with each other through the cation-exchange membrane 36 provided along the circumference of the inner tank 32. A detachable rod-like cathode 38 is provided in the inner tank 32 so as to be in contact with the fixing solution, and an anode 40 shaped like a hollow cylinder is provided in the outer tank 34 so as to be in contact with the electrolytic solution, so that a current is applied between the two electrodes 38 and 40. It is preferable in the point of view of current conduction efficiency that the volume of the inner tank 32 be set in a range of from about one-third to about two-thirds as much as the volume of the outer tank 34, or in other words the quantity of the fixing solution is set in a range of from about one-third to about two-thirds as much as the quantity of the electrolytic solution.

A fixing solution inlet 42 and a fixing solution outlet 44 are respectively provided in the upper and lower portions of the inner tank 32. An electrolytic solution overflow port 46 and an electrolytic solution inlet 48 are respectively provided in the upper and lower portions of the outer tank 34. The fixing solution inlet 42 and the fixing solution outlet 44 are connected to the fixing tank in such a manner that the fixing solution can be circulated between the fixing tank and the current conduction tank 30 by a pump.

Silver ions in the fixing solution introduced into the inner tank 32 are precipitated on the cathode 38 and, on the other hand, bromine ions in the fixing solution pass through the anion-exchange membrane 36 and reach the anode 40. Accordingly, in the inner tank 32 in which the cathode 38 is provided, not only are silver ions removed from the fixing solution to thereby regenerate thiosulfuric acid ions, but bromine ions are removed to thereby prevent inhibition of fixing. As a result, the fixing ability of the fixing solution is recovered. After the recovery of the fixing solution in the inner tank 32, the fixing solution returns from the outlet 44 to the fixing tank to thereby be reused in the fixing treatment.

It is necessary to supplement the electrolytic solution continuously. Although any supplementary solution can be used for supplementing the electrolytic solution, fixing waste fluid overflowing from the fixing tank and washing waste fluid overflowing from the washing tank may be used as an electrolytic solution so that the quantity of waste fluid can be reduced by the quantity of the electrolytic solution to be supplemented.

Figure 4:
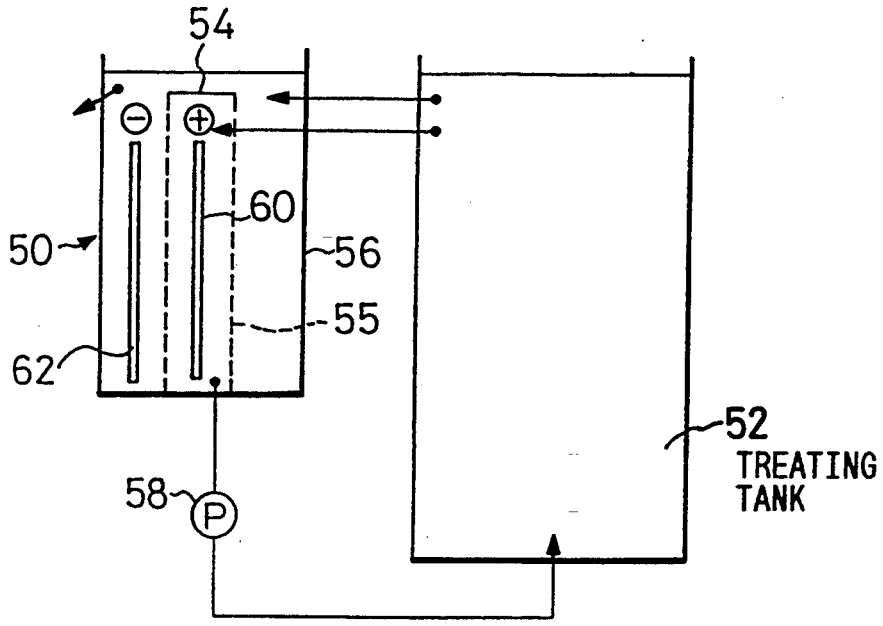
FIG. 4 is a view showing the state where a current conduction tank and a treatment tank are connected.

FIG. 4 is a diagram showing the connection between a current conduction tank 50 as a modified example and a treatment tank 52. The current conduction tank 50 includes an inner tank 54 and an outer tank 56, each of which is shaped like a hollow rectangular parallelepiped. The inner tank 54 is connected to the treatment tank 52 so that a treatment solution can be circulated by a pump 58. An anion-exchange membrane 55 is provided as a part of the inner tank 54. An anode 60 is provided so as to be in contact with the treatment solution in the inner tank 54. A cathode 62 is provided so as to be in contact with the electrolytic solution in the outer tank 56.

In the case where the anode 60 and the cathode 62 are respectively provided in the inner tank 54 and the outer tank 56, examples of a treatment solution capable of being regenerated in the inner tank 54 include a bleaching solution for color negative film and a blixing (bleaching-fixing) solution for color paper. In the case where the cathode and the anode are respectively provided in the inner tank 54 and the outer tank 56 so that the polarity is reversed with respect to the polarity shown in FIG. 4, examples of the treatment solution capable of being regenerated in the inner tank 54 include a developing solution for color negative film, a fixing solution for color negative film, and a blixing solution for color paper.

Further, solution overflowing from the fixing tank may be introduced for supplementing the electrolytic solution in the outer tank 56 when the bleaching solution for color negative film is regenerated in the inner tank 54.

The above-mentioned relationships between the cathode, the anode and the treatment solution can be applied both to the previously described current conduction structure and to the following current conduction structure.

Figure 5:
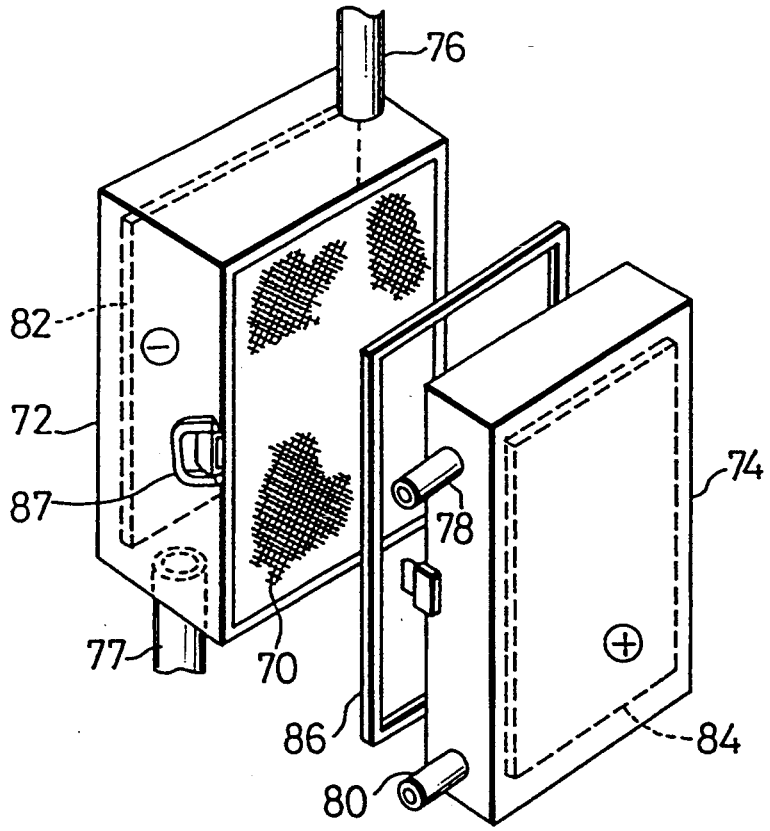
FIG. 5 is an exploded perspective view of a current conduction cartridge.

FIG. 5 is an exploded perspective view of a detachable current conduction cartridge which is attached to the treatment tank and which can be separated at a anion-exchange membrane 70 portion. The anion-exchange membrane 70 is provided at an opening portion of one 72 of treatment chambers 72 and 74, each of which opens at only one side. A treatment solution inlet 76 and a treatment solution outlet 77 are connected to the treatment chamber 72 on one side of the anion-exchange membrane 70. An electrolytic solution inlet 78 and an electrolytic solution outlet 80 are provided in the treatment chamber 74 on the other side of the anion-exchange membrane 70. A cathode 82 and an anode 84 are provided in the treatment chambers 72 and 74, respectively. The two treatment chambers 72 and 74 are connected through a packing 86 so that liquid is sealed. Subsequent to sealing, the two treatment chambers 72 and 74 are fixed by a fixing member 87 so that the same current conduction process as described above can be carried out.

Figure 6:
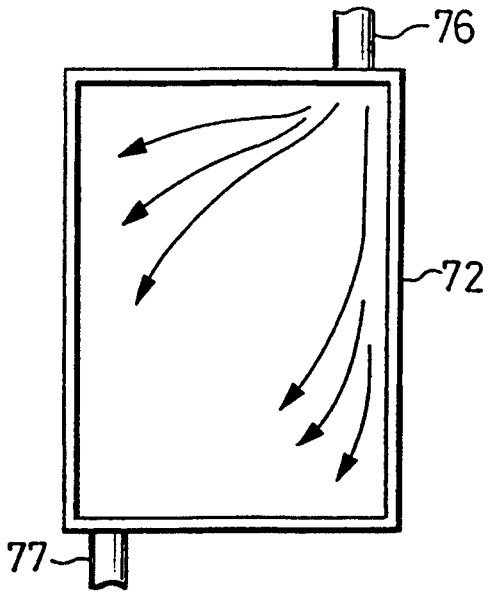
FIG. 6 is a view showing the fluid state of a treatment solution in a treatment chamber.

In order to introduce a treatment solution into the treatment chamber 72, the inlet 76 and the outlet 77 are preferably arranged so as to be placed in diagonal positions on a vertical section as shown in FIG. 6. By placing the inlet 76 and the outlet 77 in diagonal positions, the current conduction process can be carried out effectively because the introduced treatment solution flows into the treatment chamber in a balanced condition such that the liquid in contact with the entire surface of the anion-exchange membrane 70 can always move without any of the solution stagnating.

Figure 7:
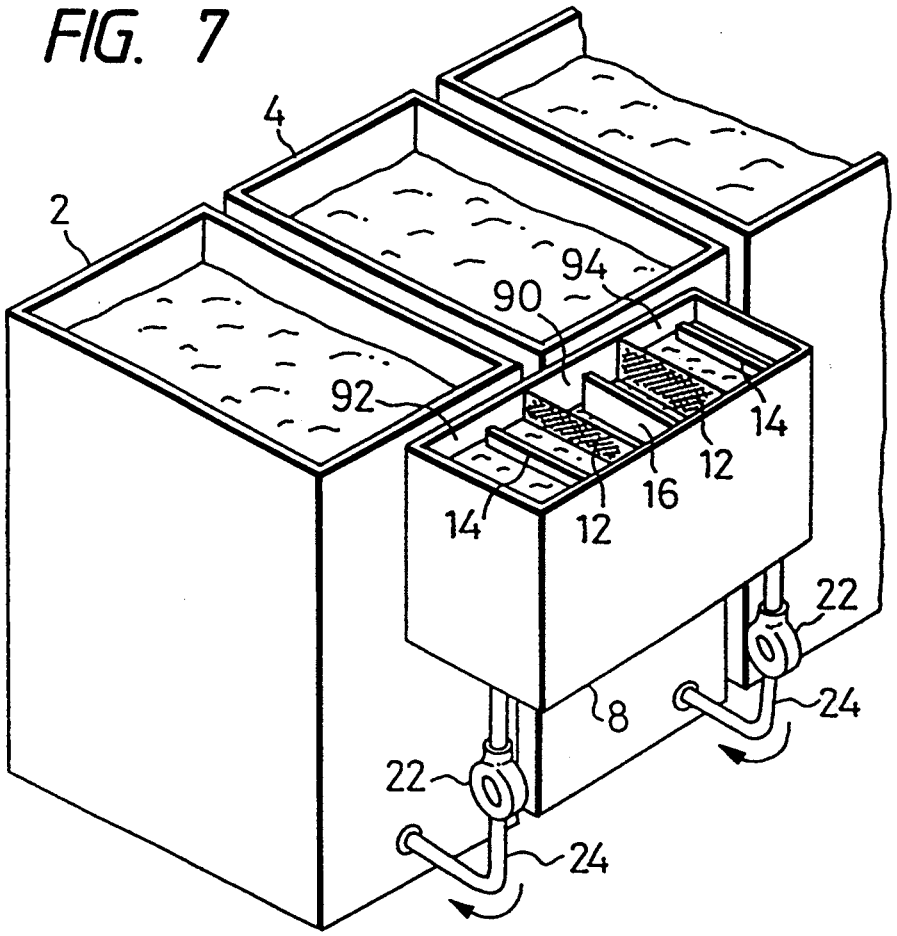
FIG. 7 is a perspective view of a modified example of the developing tank portion of the light-sensitive material treatment apparatus.

FIG. 7 is a perspective view of a modified example of the structure depicted in FIG. 1. In FIG. 7, an auxiliary tank 8 for supplying supplementary solutions to adjacent treatment tanks 2 and 4 and for circulating treatment solutions is formed in a unitary manner such that a current conduction tank 90 can be used commonly. In the example shown in FIG. 7, the auxiliary tank 8 is separated into an auxiliary tank 92 for the developing tank 2, an auxiliary tank 94 for the fixing tank 4, and the current conduction tank 90. The auxiliary tank 92 for the developing tank 2 is provided so that the developing solution can be circulated between the developing tank 2 and the auxiliary tank 92. The auxiliary tank 94 for the fixing tank 4 is provided so that the fixing solution can be circulated between the fixing tank 4 and the auxiliary tank 94. Respective cathodes 14 are provided in the auxiliary tanks 92 and 94. The current conduction tank 90 is formed between the two auxiliary tanks 92 and 94 by separating the auxiliary tank 8 with two anion-exchange membranes 12. An anode 16 is provided in the current conduction tank 90. The current conduction tank 90 is filled with an electrolytic solution. A supplementary solution is supplied to the current conduction tank 90, but it is preferable in the point of view of reduction of the quantity of waste fluid that a solution overflowing from the washing tank following the fixing tank be used as the solution for supplementing the electrolytic solution.

Because one current conduction tank 90 is used in common with adjacent treatment tanks, the number of current conduction tanks 90 can be reduced. Accordingly, the respective treatment solutions can be regenerated by applying the current conduction process to the respective treatment solutions without an increase in size of the treatment apparatus.

Figure 8:
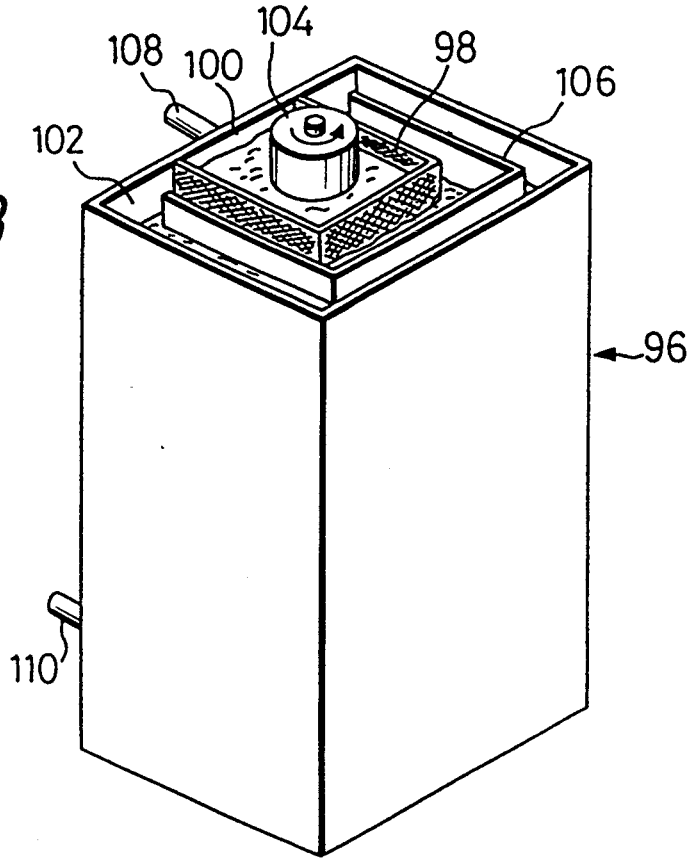
FIG. 8 is a perspective view of a modified example of the current conduction tank.

FIG. 8 is a perspective view of a modified example of the current conduction tank, showing a desirable structure for regeneration of a fixing solution. A current conduction tank 96 is separated by a anion-exchange membrane 98 to form an inner chamber 100 and an outer chamber 102, each of which is shaped like a rectangle in horizontal section. A cylindrical cathode 104 is provided in the inner chamber 100. An anode 106 is provided in the outer chamber 102 positioned so that the anode 106 is opposite to the cathode 104 in three directions. During current conduction, the cathode 104 is driven by a motor (not shown) so that the entire cylindrical surface of the cathode 104 is rotated so as to be uniformly opposite to the anode 106. The fixing solution is connected to the fixing tank through an inlet 108 and an outlet 110, so that the fixing solution is circulated between the fixing tank and the inner tank 100.

When the current conduction process is applied to the fixing solution, metal silver is precipitated on the cathode 104 by donating electrons from the cathode 104 to silver ions dissolved in the fixing solution by desilverization. Accordingly, by carrying out the current conduction process while rotating the cylindrical cathode 104, metal silver can be precipitated uniformly on the cathode 104. Furthermore, by making the cylindrical cathode 104 easily detachable, the cathode 104 can be detached from the current conduction cartridge 96 so that metal silver can be easily removed from the surface of the cathode 104. To remove the metallic silver from the cathode 104, the cathode 104 can be knocked by a hammer or the like.

Septa, such as anion-exchange membranes, anion-exchange membranes, and the like, become blocked with the advance of the current conduction process, so that the efficiency $\eta$ is lowered. Therefore, the lowering of the current conduction efficiency $\eta$ caused by blocking or the like can be compensated by increasing the quantity of current conduction.

Figure 9:
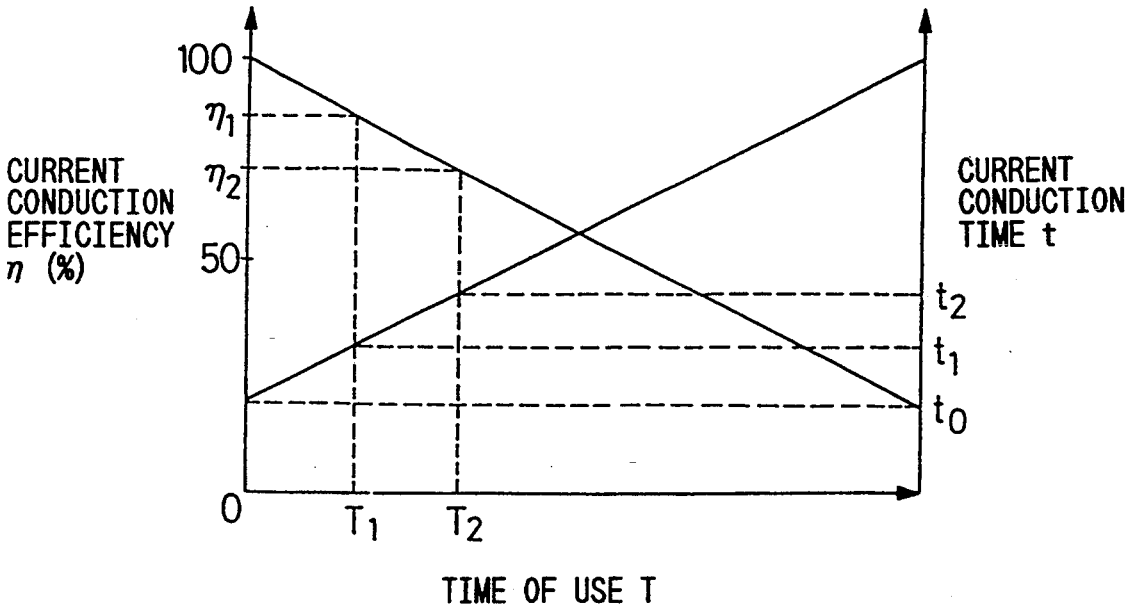
FIG. 9 is a graph showing the relations of current conduction efficiency and current conduction time with respect to the time of use.

FIG. 9 is a graph for explaining current conduction control in which functional deterioration of septa is compensated by the quantity of current conduction. Because the current conduction efficiency $\eta$ is lowered with the time of use T, the lowering of current conduction efficiency $\eta$ can be compensated by increasing the current conduction time during each current conduction process during each working day, increasing the current or voltage for current conduction, or increasing the quantity of current conduction in accordance with the time of use T.

For example, in the case where the lowering of current conduction efficiency $\eta$ is compensated by increasing the current conduction time t, a constant quantity of current conduction can be obtained consequently if the current conduction time t is increased in an amount corresponding to the lowering of current conduction efficiency $\eta$. Here, detection and calculation of the state of lowering of the current conduction efficiency $\eta$ and the current conduction time t sufficient to compensate the lowering state, on each occasion, are complex. Therefore, the state of lowering of the current conduction efficiency $\eta$ with respect to the time T during which a septum is used, as shown in FIG. 9, is preliminarily experimentally measured corresponding to factors such as the type of the septum, the type of the treatment solution to be regenerated, the type of the light-sensitive material to be treated, and the like. To compensate the lowering of current conduction efficiency $\eta$ by increasing the current conduction timer t, the current conduction time t is controlled so that the product of current conduction efficiency $\eta$ and current conduction time t is kept constant. Then, the relationship between the time of use T and the current conduction efficiency $\eta$ is stored in the form of a look-up table or the like, so that subsequently the current conduction time can be controlled by reference to the look-up table for each current conduction process.

To obtain the preferred constant value of the current conduction efficiency $\eta$, the current conduction time t is increased to obtain the values of current and voltage corresponding to the lowering of the current conduction efficiency $\eta$ of the treatment solution, but current conduction may be controlled so that the product ($\eta \cdot t$) of the value of current conduction efficiency $\eta$ with the passage of time and the value of the current conduction time t for compensating the lowering of current conduction efficiency $\eta$ is kept constant.

Figure 10:
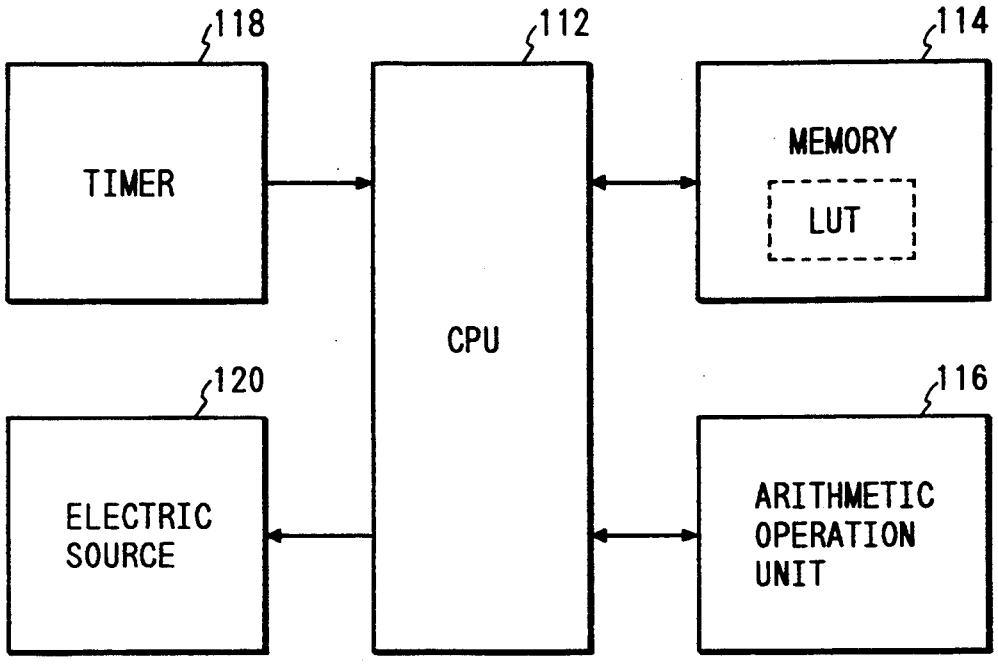
FIG. 10 is a block diagram of a current conduction control apparatus.

FIG. 10 is a block diagram showing a control system for compensating the lowering of current conduction efficiency. A controller 112 is connected to a memory 114 in which a look-up table (LUT) having the above-mentioned data is stored, an arithmetic operation unit 116, a timer 118 and an electric source 120. The controller 112 controls the starting of the electric source 120 by reference to the data in the memory 114 corresponding to the time of use T measured by the timer 118.

When the use time T is zero, the current conduction efficiency $\eta_0$ is 100%. At this time, the initial current conduction time is $t_0$. Because the product ($\eta_0 \cdot t_0$) of current conduction efficiency $\eta_0$ and current conduction time $t_0$ at the initial state is preliminarily stored in the memory 114, current conduction control is subsequently performed so that this value is kept constant. When, for example, the time of use T reaches $T_1$, the current conduction efficiency is lowered to $\eta_1$. The controller 112 searches for the value of current conduction efficiency $\eta_1$ corresponding to the use time $T_1$ by reference to the data in the memory 114 on the basis of the time of use T measured by the timer 118. To compensate the lowering of the current conduction efficiency $\eta_1$, the current conduction time may be increased to $t_1$. The current conduction time $t_1$ can be calculated easily on the basis of the value of $\eta_0 \cdot t_0$ stored in the memory 114 and the value of current conduction efficiency $\eta_1$ retrieved as described above. When the time of use T further progresses from $T_1$ to $T_2$, the current conduction time $t_2$ is calculated in the same manner as described above on the basis of the value of current conduction efficiency $\eta_2$ corresponding to the time of use $\eta_2$ stored in the memory 114 and the value of $\eta_0 \cdot t_0$ stored in the memory 114. Current conduction is then performed for the current conduction time $t_2$.

Not only the state of lowering of the current conduction efficiency $\eta$ corresponding to the use time T, but also the current conduction time t for compensating the lowering of current conduction efficiency may be stored in the memory 114, so that current conduction can be controlled by reference to the current conduction time t corresponding to the time of use stored in the memory 114.

Although the above description relates to the case where current conduction is controlled on the basis of the current conduction time t, the invention can be applied to the case where current conduction is corrected on the basis of the value of the current or voltage used instead of the current conduction time t. In the case where the current conduction time t represented by the right ordinate of the graph in FIG. 9 is replaced by the value of current or voltage, a correction line having a similar form is obtained.

According to the above-described current conduction operation, the quantity of current conduction with respect to the treatment solution as a subject of current conduction is kept substantially constant, even in the case where the current conduction efficiency of the septum is lowered with the passage of time. Accordingly, current conduction can be performed while a good current conduction state is maintained, so that continuous regenerating the treatment solution is maintained.

According to the present invention, a treatment solution can be regenerated by carrying out a current conduction process using an auxiliary tank for supplying a treatment supplementary solution. Accordingly, a treatment apparatus used conventionally can be used as a treatment apparatus having a treatment solution regenerating function without increasing the size of the apparatus. Furthermore, bromine ions (unnecessary matter) produced by development of a light-sensitive material are evaporated at an anode so as to be discharged. Therefore, unnecessary and unwanted components are prevented from accumulating in the developing solution. Accordingly, discharging the unnecessary components by overflow is not required, so that there is no production of waste fluid. Some supplementary solution must of course still be provided so that the quantity lost by adherence to the light-sensitive material and evaporation can be supplemented. However, the quantity of the supplementary solution is very small.

What is claimed is:

1. An apparatus for treating a silver halide photographic light-sensitive material, comprising:

an auxiliary tank for communicating with a developing tank and for containing developing solution and receiving a supplementary solution;

a current conduction tank for containing an electrolytic solution, said electrolytic solution contacting said developing solution in said auxiliary tank through a septum when contained in said current conduction tank;

a cathode for contacting said developing solution in said auxiliary tank;

an anode for contacting said electrolytic solution;

means for applying a current between said anode and said cathode; and a nozzle for supplying said supplementary solution to said auxiliary tank, said nozzle extending downward into said auxiliary tank and having a supplementary port and an open end for contacting said developing solution contained in said auxiliary tank.

2. The treatment apparatus according to claim 1, wherein said supplemental port opens obliquely.

3. The treatment apparatus according to claim 1, wherein said supplemental port is a vertical slit.

4. The treatment apparatus according to claim 1, wherein the pH of said developing solution is in a range of 1 to 7.

5. The treatment apparatus according to claim 1, wherein the pH of said developing solution is in a range of 2 to 6.

6. The treatment apparatus according to claim 1, wherein a portion of said developing tank is open to a surrounding atmosphere.

7. The treatment apparatus of claim 1, wherein said developing tank is sealed.

8. The treatment apparatus of claim 1, wherein said septum comprises an anion-exchange membrane.

9. The treatment apparatus of claim 1, wherein said developing solution comprises a chelating agent.

10. The treatment apparatus of claim 9, wherein said chelating agent has a theoretical metallic ion chelating activity of not less than 1.1 mol with respect to a metallic ion contained therein.

11. The treatment apparatus of claim 9, wherein said chelating agent has a theoretical metallic ion chelating activity of not less than 2.0 mol with respect to a metallic ion contained therein.

12. The treatment apparatus of claim 9, wherein said chelating agent has a molecular weight in a range of 400 to 1,000,000.

13. The treatment apparatus of claim 9, wherein said chelating agent has a stability constant in a range of 2.0 to 40.00.

14. The treatment apparatus of claim 1, wherein a voltage between said electrodes in the presence of said current is in a range of 0.3 to 5 V.

15. An apparatus for treating a light-sensitive material, comprising:

a developing tank for containing a developing solution having a developing agent of a type which changes to an oxidized state by reaction with silver halide and returns to a reduction state by electronation;

a current conduction tank for containing an electrolytic solution, said electrolytic solution contacting said developing solution through a septum when contained in said current conduction tank;

a cathode for contacting said developing solution in said developing tank;

an anode for contacting said electrolytic solution;

means for applying a current between said anode and said cathode;

means for determining time periods during which said septum is in use;

means for storing treatment efficiency values corresponding to said time periods during which said septum is in use;

arithmetic operation means for calculating products of respective ones of said treatment efficiency values and said time periods during which said septum is in use; and means for controlling said current between said anode and said cathode so that said products are kept constant.

16. An apparatus for treating a light-sensitive material including a current conduction cartridge, comprising:

an inner tank for containing one of a photographic treatment solution and an electrolytic solution;

an outer tank for containing said electrolytic solution when said inner tank contains said photographic treatment solution and for containing said photographic treatment solution when said inner tank contains said electrolytic solution, said inner and outer tanks formed by separating at least one part of said current conduction cartridge by a septum; and two different-polarity electrodes for contacting said treatment solution and said electrolytic solution, respectively, wherein said current conduction cartridge is provided to regenerate said treatment solution by applying a current between said different-polarity electrodes, said current conduction cartridge adaptable for detachably attaching to a treatment solution circulating path in a body of said treatment apparatus.

17. An apparatus for treating a light-sensitive material including a current conduction cartridge, comprising:

an inner tank for containing one of a photographic treatment solution and an electrolytic solution;

an outer tank for containing said electrolytic solution when said inner tank contains said photographic treatment solution and for containing said photographic treatment solution when said inner tank contains said electrolytic solution, said inner and outer tanks formed by separating at least one part of said current conduction cartridge by a septum; and two different-polarity electrodes for contacting said treatment solution and said electrolytic solution, respectively, wherein said current conduction cartridge is provided-to regenerate said treatment solution by applying a current between said different-polarity electrodes, at least one of said electrodes has a cylindrical shape, said current conduction cartridge adaptable for detachably attaching to a treatment solution circulating path in a body of said treatment apparatus.

18. An apparatus for treating a light-sensitive material including a current conduction cartridge, comprising:

an inner tank for containing one of a photographic treatment solution and an electrolytic solution;

an outer tank an outer tank for containing said electrolytic solution when said inner tank contains said photographic treatment solution and for containing said photographic treatment solution when said inner tank contains said electrolytic solution, said inner and outer tanks formed by separating at least one part of said current conduction cartridge by a septum, said current conduction cartridge being disposed in a treatment solution circulating path in a body of said treatment apparatus in such a manner that either one of said tanks is attachable to said septum and detachable from said septum; and two different-polarity electrodes for contacting said treatment solution and said electrolytic solution, respectively, wherein said current conduction cartridge regenerates said treatment solution by applying a current between said two different-polarity electrodes.

19. An apparatus for treating a light-sensitive material including a current conduction cartridge comprising:

an inner tank for containing one of a photographic treatment solution and an electrolytic solution;

an outer tank for containing said electrolytic solution when said inner tank contains said photographic treatment solution and for containing said photographic treatment solution when said inner tank contains said electrolytic solution, said inner and outer tanks formed by separating at least one part of said current conduction cartridge by a septum, said current conduction cartridge being disposed in a treatment solution circulating path in a body of said treatment apparatus in such a manner that either one of said tanks is attachable to said septum and detachable from said septum; and two different-polarity electrodes for contacting said treatment solution and said electrolytic solution, respectively, wherein said current conduction cartridge regenerates said treatment solution by applying a current between said two different-polarity electrodes;

wherein said cartridge has a liquid inlet and a liquid outlet located in diagonal positions with respect to one another.

20. A treatment apparatus according to claim 1, wherein said developing solution is inorganic.

21. A treatment apparatus according to claim 1, wherein said developing tank is of a low opening degree type in which $K = S/V$ satisfying the following relationship:

$$\log K < -1.8 \times 10\ V - 1.5$$

where S represents the surface area ($cm^2$) of a surface portion of a liquid in said developing tank, V represents the volume ($cm^3$) of said developing tank, and K represents the opening degree s/v ($cm^{-1}$).

22. A treatment apparatus according to claim 9, wherein said chelating agent is a transition metal complex having a multidentate ligand.

23. An apparatus as claimed in claim 16, wherein both said inner and outer tanks have a hollow rectangular parallelepiped shape.

24. An apparatus as claimed in claim 16, wherein both said inner and outer tanks have a hollow cylindrical shape.

* * * * *